US010422102B1

(12) United States Patent
Fontaine et al.

(10) Patent No.: US 10,422,102 B1
(45) Date of Patent: Sep. 24, 2019

(54) SYSTEMS AND METHODS USING EXPENDABLE FLUID DRIVE ACTUATORS FOR FOUNDATION LIFTING

(71) Applicant: Tella Firma, LLC, Richardson, TX (US)

(72) Inventors: James Fontaine, Plano, TX (US); Carlos Hoefken, Dallas, TX (US); William Basso, Coppell, TX (US)

(73) Assignee: Tella Firma, LLC, Richardson, TX (US)

( * ) Notice: Subject to any disclaimer, the term of this patent is extended or adjusted under 35 U.S.C. 154(b) by 0 days.

(21) Appl. No.: 15/928,731

(22) Filed: Mar. 22, 2018

(51) Int. Cl.
*E02D 35/00* (2006.01)

(52) U.S. Cl.
CPC ..... *E02D 35/005* (2013.01)

(58) Field of Classification Search
CPC ..... E02D 35/00; E02D 35/005
USPC ..... 405/230
See application file for complete search history.

(56) References Cited

U.S. PATENT DOCUMENTS 2,322,855 A * 6/1943 Lenahan ..... E02D 35/00 405/230
3,710,523 A 1/1973 Taylor
4,258,516 A 3/1981 Mori et al.
4,348,841 A 9/1982 Ueno et al.
4,906,140 A * 3/1990 Clark ..... E02D 35/00 405/230
5,575,593 A 11/1996 Raaf
5,791,097 A 8/1998 Winston et al.
6,050,207 A * 4/2000 Mays ..... E02D 27/00 114/45
6,206,615 B1 * 3/2001 Adsbøll ..... E02D 37/00 405/230
6,722,821 B1 4/2004 Perko et al.
6,923,599 B2 8/2005 Kelso
7,556,453 B2 * 7/2009 Collina ..... E02D 5/28 405/229
7,823,341 B2 11/2010 Kelly et al.
8,069,620 B2 12/2011 Kelly et al.
8,407,898 B2 4/2013 Marshall
8,458,984 B2 8/2013 Marshall
(Continued)

FOREIGN PATENT DOCUMENTS

CA 2628422 A1 2/2007

*Primary Examiner* — Frederick L Lagman
(74) *Attorney, Agent, or Firm* — Norton Rose Fulbright US LLP

(57) ABSTRACT

Systems and methods are provided for foundation lifting and retention using fluid drive actuators are described. A foundation lift system of embodiments may include expendable fluid drive actuators operable to provide lifting forces with respect to a foundation structure using a fluid pressure (e.g., hydraulic and/or pneumatic) drive mechanism and utilize one or more locking mechanisms and/or fluids operable to persistently lock the lift assemblies in an extended state to retain the foundation structure in its lifted position. Curable fluids injected into expendable fluid drive actuators of embodiments may be configured to solidify within the drive mechanism and impede movement of the lift assemblies subsequent to a foundation lifting operation. Additionally, one or more locking mechanisms may be configured to engagedly retain the expendable fluid drive actuator in an extended state subsequent to the foundation lifting operation.

25 Claims, 5 Drawing Sheets

(56) References Cited

U.S. PATENT DOCUMENTS

| | | | | |
|---|---|---|---|---|
| 8,671,627 | B2 | 3/2014 | Marshall | |
| 8,678,712 | B2 | 3/2014 | Marshall | |
| 2002/0062622 | A1* | 5/2002 | Bell | E02D 35/00 52/741.15 |
| 2004/0037653 | A1* | 2/2004 | Kelso | E02D 27/48 405/236 |
| 2006/0067794 | A1* | 3/2006 | Mitchell | E02D 27/48 405/230 |
| 2007/0028557 | A1* | 2/2007 | Kelly | E02D 27/34 52/741.15 |
| 2011/0052329 | A1* | 3/2011 | Marshall | E02D 31/08 405/229 |
| 2011/0116873 | A1* | 5/2011 | Marshall | E02D 35/00 405/230 |
| 2012/0114423 | A1* | 5/2012 | Zago | E02D 35/00 405/230 |
| 2012/0288335 | A1 | 11/2012 | Green | |

* cited by examiner

SYSTEMS AND METHODS USING EXPENDABLE FLUID DRIVE ACTUATORS FOR FOUNDATION LIFTING

CROSS-REFERENCE TO RELATED APPLICATIONS

The present application is related to co-pending and commonly assigned U.S. patent application Ser. No. 15/902,774 entitled "SYSTEMS AND METHODS FOR FOUNDATION LIFTING WITH LOCKING CAP" filed Feb. 22, 2018, and Ser. No. 15/232,170 entitled "SYSTEMS AND METHODS FOR INSTALLING AND STABILIZING A PIER" filed on Aug. 9, 2016, the disclosures of which are hereby incorporated herein by reference.

TECHNICAL FIELD

The present application relates to foundation lifting and, more specifically, to foundation lifting systems and methods using expendable fluid (e.g., liquid, gas, slurry, etc.) drive actuators configured for persistently locking a foundation in a lifted position.

BACKGROUND OF THE INVENTION

The quality of a structure, whether it is a house, apartment building, or commercial building, is inextricably tied to its foundation. If the structure is not built on a proper foundation, the rest of the structure, even if properly constructed, is likely to show defects over time. When foundations are constructed directly on ground soils, it often creates an unstable environment for the foundation. In addition, if these soils are active or expansive, the environment may be especially problematic. For example, in regions where the soil has a high percentage of active clay, expansion and contraction of the clay subjects the foundations to significant loads (e.g., forces) and potential movement.

Structures built on soils in certain regions may have had their slab foundations and walls displaced and damaged (e.g., cracked foundations and walls) as a result of differential expansion and/or contraction of the soil. Over time, engineers have developed systems and methods for designing foundations in an attempt to minimize damage due to soil movement. Some of these systems and methods include isolating heavy slab foundations from the active soils by suspending the slab above the ground using structural supports (e.g., helical piers, drilled shaft piers, pressed concrete or steel pilings, spread footings, natural rock, etc.) and lifting assemblies (e.g., lifting bolts, hydraulic jacks, air-inflatable jacks, electrical scissor jacks, etc.). For example, U.S. Pat. No. 7,823,341, HEIGHT-ADJUSTABLE, STRUCTURALLY SUSPENDED SLABS FOR A STRUCTURAL FOUNDATION, issued on Nov. 2, 2010, which is incorporated by reference herein, discloses a method of lifting a slab foundation using structural supports and lifting assemblies. The installation of supports and lifts to raise the slab foundation creates a protective void between the soil and the slab foundation, such as may permit the vertical expansion of the soil without subjecting the slab foundation to varying forces associated with the dynamic nature of soil.

Many existing systems and methods for lifting slab foundations after their formation on the ground surface use linear actuators (e.g., hydraulic, pneumatic, etc.) to raise a formed slab foundation. The exterior housing of the actuator is often secured to the slab foundation while a ram (e.g., rod, shaft, etc.) extends out from the actuator to engage a subjacent structural support. Activating (e.g., hydraulically, pneumatically, etc.) the actuator causes the ram to apply a direct pushing force along an axis of intended lifting against the subjacent structural support. As the subjacent structural support is often statically embedded in the ground surface, the pushing force is transferred into a lifting force against the exterior housing of the actuator and the slab foundation in which the exterior housing is engaged, thereby raising the slab foundation above the ground surface.

However, conventional hydraulic and pneumatic lifting assemblies are typically designed for temporary and/or semi-permanent lifting. Accordingly, they not designed to sustain continual downward forces (e.g., gravitational) related to the weight of a lifted slab foundation and a structure and/or occupants thereupon. Conventional pneumatic and hydraulic actuators often fail if not properly maintained or if subjected to repeated use and/or stressful environments (e.g., operating over extreme stress, parts corrosion, seal leakage, etc.). Actuator failures may cause the slab foundation to sink over time or, in extreme situations, collapse. Further, since lifting assemblies are typically displaced underneath a lifted slab foundation and may be difficult to access for maintenance and/or repairs, these actuator failures are difficult to mitigate.

BRIEF SUMMARY OF THE INVENTION

The present invention is directed to systems and methods which provide for foundation lifting and retention using an expendable foundation lifting system comprising fluid drive actuators configured for locking a foundation in a lifted position. For example, fluid drive actuators of embodiments are operable to provide lifting forces with respect to a foundation structure using a fluid pressure (e.g., hydraulic and/or pneumatic) drive mechanism and utilize one or more locking mechanisms and/or fluids operable to retain the lift assemblies in an extended state to retain the foundation structure in its lifted position.

Expendable fluid drive actuators of foundation lifting systems of embodiments may include a piston housing and a ram (e.g., rod being actuated by fluid pressure provided within the piston housing). The piston housing may comprise an outer sleeve (e.g., pipe, etc.), an interior piston chamber, a structurally sealed end configured with one or more fluid ports operable to allow passage of fluids (e.g., oil, water, air, purified gas, grout, cement, etc.) into a portion of the piston chamber to create a fluid chamber, and an opening (e.g., orifice, etc.) for receiving a ram. The ram may be slidably mounted within the piston chamber of the piston housing via the opening and may include a piston head (e.g., a seal corresponding to the interior dimensions of the piston chamber) configured to delineate the fluid chamber within the piston chamber and a shaft of the ram. The piston housing or ram may be configured for engaging with a subjacent structural support (e.g., base plates, helical piers, drilled shaft piers, pressed concrete or steel pilings, spread footings, natural rock, etc.) embedded or otherwise engaged in a ground surface, whereas the other one of the ram or piston housing may be configured for engaging with the foundation structure (e.g., using embedded anchors, underlying support plates, etc.).

In operation according to embodiments, the expendable fluid drive actuators of a foundation lifting system may be installed in a compressed state (e.g., the ram fully or near fully engaged within the piston housing) over the subjacent structural support, whereby forces may be applied between the subjacent structural support and the foundation structure by the expendable fluid drive actuators. Accordingly, the foundation structure may be raised above the ground surface by operation of the fluid drive actuators, thereby creating a protective void space between the lifted foundation structure and the ground surface.

Expendable fluid drive actuators of foundation lifting systems of embodiments are configured for sacrificial use with respect to a lifted foundation, whereby the expendable fluid drive actuators of an instance of a foundation lifting system remain permanently or substantially permanently (i.e., throughout their useful life) with their respective foundation structure. Accordingly, embodiments of the present invention operate to retain a foundation structure in a lifted position by mitigating a cause of failure of conventional hydraulic and pneumatic linear actuators related to their reusable and temporary nature. For example, expendable fluid drive actuators of embodiments of the invention may be configured to accept chemically curable media (e.g., poured cement, grout, epoxy, etc.) within the fluid chamber (e.g., displacing fluids under pressure used to raise the foundation structure, operating as the fluid under pressure to raise the foundation structure, etc.) for locking a foundation in a lifted position. Additionally or alternatively, expendable fluid drive actuators of embodiments may be configured with one or more locking mechanisms operable to engagedly retain the expendable fluid drive actuator in an extended state for locking a foundation structure in a lifted position. Accordingly, expendable foundation lifting systems of embodiments may be suitable for resisting and enduring the continual forces related to the weight of a lifted slab foundation and a structure and/or occupants thereupon.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
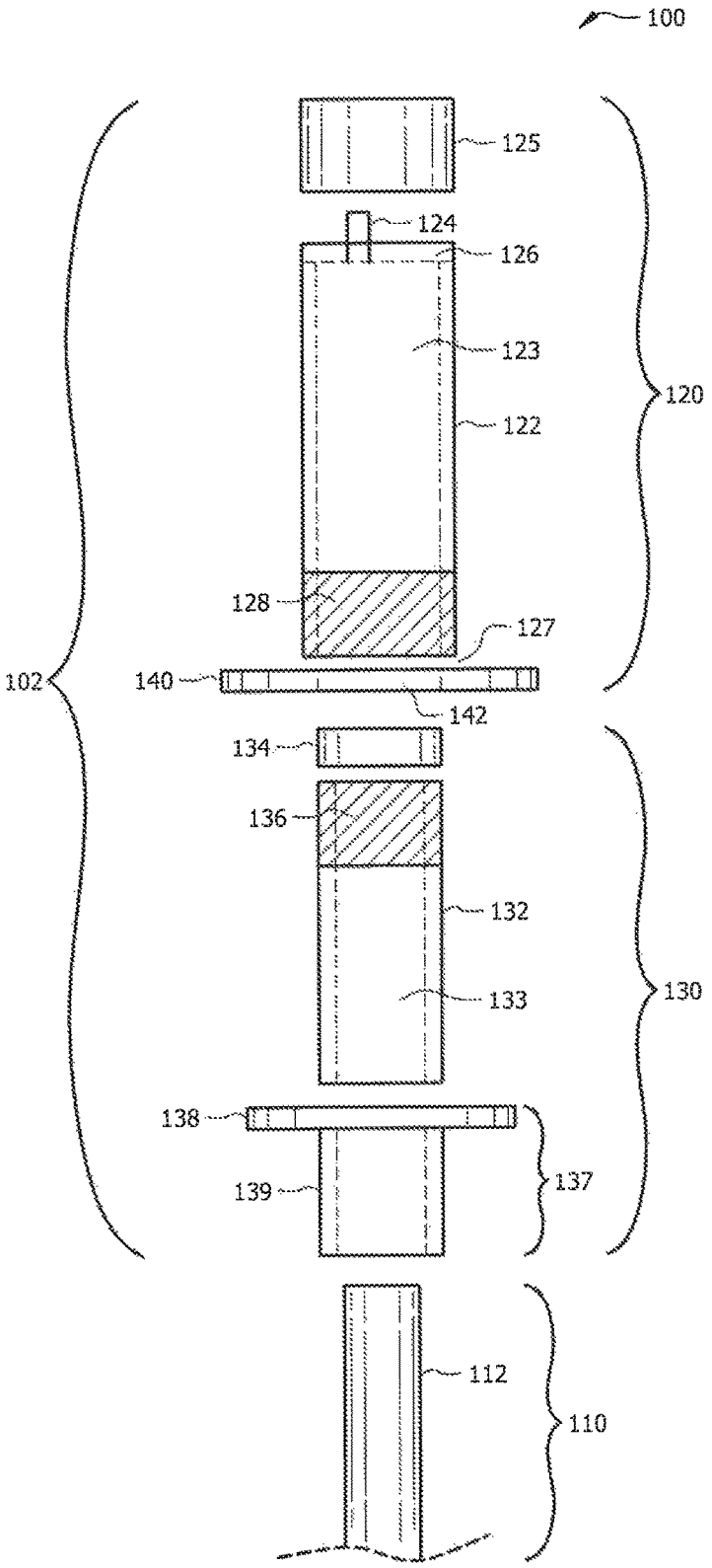
FIG. 1 illustrates an exploded view of an expendable foundation lift system of embodiments of the present invention.

FIG. 1 depicts an exploded view of embodiments of an expendable foundation lift system in accordance with concepts of the present invention. Foundation lift system 100 of the illustrated embodiment is configured to raise a foundation structure to a lifted position and retain the foundation structure in the lifted position. Accordingly, foundation lift system 100 shown in FIG. 1 includes expendable fluid drive actuator 102 and structural support 110. Expendable fluid drive actuator 102 of foundation lifting system 100 includes piston housing 120 and ram 130 having corresponding locking mechanisms and/or curable fluid media, in accordance with the concepts herein, utilized in retaining the foundation structure in a lifted position.

Figure 2B:
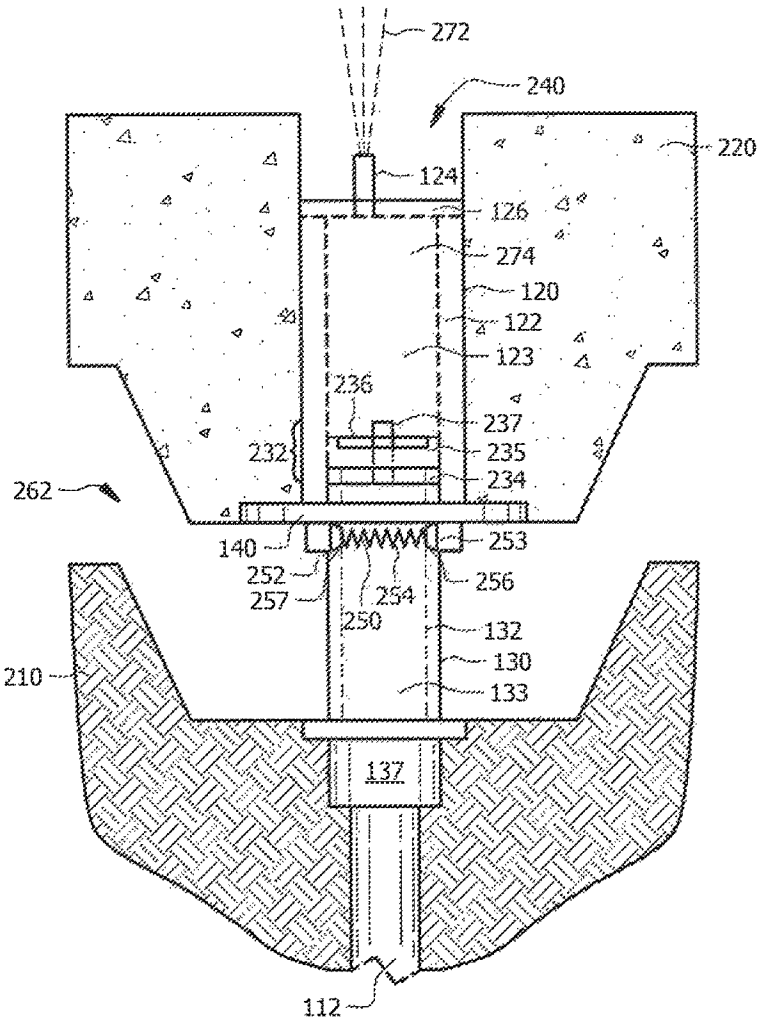
FIGS. 2A and 2B illustrate operation of an expendable foundation lift system of embodiments of the present invention in persistently locking a foundation in a lifted position.
Figure 2A:
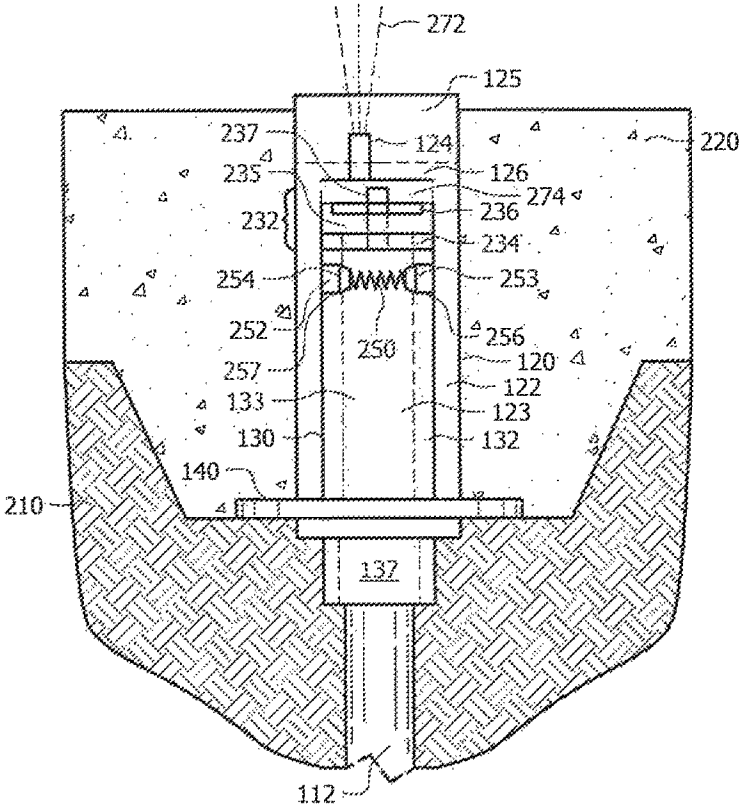

Piston housing 120 of the illustrated embodiment of expendable fluid drive actuator 102 includes sleeve 122, piston chamber 123, fluid port 124, plug 125, end cap 126, opening 127, and lifting anchor 140. In accordance with embodiments of the invention, the components of piston housing 120 are configured to be embedded in or otherwise engaged with a foundation structure and cooperate with components of ram 130 in raising the foundation structure to a lifted position and retaining the foundation structure in the lifted position. FIGS. 2A and 2B show an example of piston housing 120 embedded in foundation structure 220 (e.g., poured concrete, reinforced concrete, etc.). In some embodiments, piston housing 120 may further include outer locking mechanism 128 configured to engage with inner locking mechanism 136 of ram 130 to retain the foundation structure in the lifted position.

Sleeve 122 of embodiments may, for example, comprise a length of pipe (e.g., different types of steel, titanium, tungsten, Inconel, aluminum, metal alloys, composite materials, carbon fiber, engineered materials, other materials suitable for operations described herein, and alloys thereof) or other structure having appropriate openings, orifices, or other configurations suitable for circumscribing piston chamber 123, as described below, and configured (e.g., sized) to extend, or substantially extend, through the media (e.g., poured concrete, etc.) of a foundation structure along an axis of intended lifting. In accordance with embodiments of the invention, the longitudinal length of sleeve 122 may be selected to correspond to a desired foundation structure thickness at a location at which sleeve 122 is to be disposed and to the length of ram 130, as discussed below. For example, the longitudinal length of sleeve 122 may be selected such that, when combined with a thicknesses of one or more other components (e.g., plug 125, end cap 126, lifting anchor 140, etc.) of piston housing 120, the combined structure will extend, or substantially extend, through the foundation structure. In the example of FIGS. 2A and 2B, wherein the combined structure substantially extends through foundation structure 220, the length of sleeve 122, thickness of plug 125, thickness of end cap 126, and thickness of lifting anchor 140 may combine to approximate the thickness of foundation structure 220 at a location at which the foundation lift interface assembly is disposed (e.g., where foundation structure 220 is 10 inches thick, the length of sleeve 122 may be 6 inches, the thickness of plug 125 may be 1 inch, the thickness of end cap 126 may be 1 inch, and the thickness of lifting anchor 140 may be 2 inches). Additionally, sleeve 122 may be configured to accommodate the longitudinal length of ram 130 (e.g., within piston chamber 123) to facilitate raising the foundation structure to the lifted position, discussed below, and the longitudinal length of sleeve 122 may correspond to the longitudinal length of ram 130. The transverse dimensions (e.g., area, perimeter, diameter and circumference, major and minor axes, cross-sectional length, etc.) of sleeve 122 may correspond to the shape (e.g., circular, elliptical, rectangular, triangular, etc.) of sleeve 122.

According to embodiments, end cap 126 of piston housing 120 may be physically coupled to an end of sleeve 122 (e.g., near a foundation top surface, etc.) and may comprise, for example, a cover (e.g., plate, disc, dome, etc.) with dimensions corresponding to the transverse dimensions and shape of sleeve 122. In operation, end cap 126 in conjunction with sleeve 122 and piston head 134 of ram 130, discussed below, may define the dimensions of piston chamber 123. End cap 126 is preferably coupled to sleeve 122 in a manner suitable to seal in fluids such as, for example, by welding, soldering, metallic adhesives, threads, or other physically coupling methods suitable for operations described herein. In some embodiments, sleeve 122 may be fabricated to include end cap 126 as a structural component thereof.

In some embodiments, plug 125 of piston housing 120 may be formed, for example, from foam or other material suitable for displacing foundation media (e.g., poured concrete) of foundation structure 220, disposed over end cap 126 when foundation structure 220 is formed (e.g., concrete is poured), and removed thereafter to reveal a foundation media fill pocket (e.g., pocket 240 of FIG. 2B) allowing access to end cap 126 and fluid port 124 during a lifting operation. For example, where the desired thickness for foundation structure 220 is 10 inches thick and the combined structure of piston housing 120, sans plug, may be 6.5 inches, the thickness of plug 125 may be selected to be 3.5 inches. After the foundation lifting operations described herein are complete, the fill pocket may be filled with foundation media or other material to conceal the components of foundation lift system 100.

In some embodiments, end cap 126 may include fluid port 124, operable as a passage for fluids (e.g., oil, water, air, purified gas, grout, cement, etc.) to enter and/or exit piston chamber 123. Fluid port 124 preferably includes a valve (e.g., piston valves, etc.) operable to control the flow of fluids entering and/or exiting piston chamber 123. In operation according to embodiments, as fluids enter piston chamber 123 via fluid port 124, the pressure (e.g., hydraulic and/or pneumatic) of the fluids in piston chamber 123 may exert a pushing force on piston head 134, as discussed below, to actuate ram 130. The dimensions of fluid port 124 may correspond to the type of fluids passing therethrough. For example, a larger valve may be used for injecting grout than for injecting pressurized water. In additional or alternative embodiments, fluid port 124 may be disposed through sleeve 122. It is noted that fluid port 124 is depicted as a singular passage for purposes of illustration, rather than by way of limitation, and, in other embodiments of expendable fluid drive actuator 102, fluid port 124 may include more than one passage operable to allow fluids into and/or out of piston chamber 123 (e.g., one or more inlet ports, one or more outlet ports, one or more bidirectional ports, or combinations thereof).

According to embodiments, piston chamber 123 of embodiments may be an interior space of sleeve 122 configured (e.g., sized, shaped, etc.) to facilitate slidably mounting ram 130 within sleeve 122 and suitable for actuating ram 130 therein, as discussed below with respect to FIGS. 2A and 2B. Piston chamber 123 preferably includes a fluid chamber (e.g., fluid chamber 274 of FIG. 2B) created by the entry of fluids into piston chamber 123 via fluid port 124 and delineated by end cap 126, sleeve 122, and piston head 134. The transverse dimensions of piston chamber 123 are preferably uniform across the longitudinal length of sleeve 122 and may correspond to the transverse dimensions and shape of the inner perimeter of sleeve 122 (e.g., dimensions of the openings, orifices, etc. of sleeve 122).

Outer locking mechanism 128 of embodiments may include apertures, eyelets, clamps, slots, bevels, locking nuts (e.g., fully threaded, partially threaded, etc.), any other interfaces and/or mechanisms suitable for engaging with inner locking mechanism 136 of ram 130 for operations described herein, or combinations thereof. Outer locking mechanism 128 is preferably disposed at an end of sleeve 122 opposite of end cap 126 (e.g., opening 127). In some embodiments, outer locking mechanism 128 may be a structural component of sleeve 122. For example, outer locking mechanism 128 may be one or more slots disposed in the interior surface of piston chamber 123 that extend along the longitudinal length of sleeve 122 (e.g., from end cap 126 to the opposing end of sleeve 122). In another example, outer locking mechanism 128 may be a plurality of eyelets disposed in the interior surface of piston chamber 123. Additionally or alternatively, outer locking mechanism 128 may be physically coupled (e.g., welded, soldered, adhered, etc.) to opening 127 and suitable for passing ram 130 therethrough. For example, outer locking mechanism 128 may be a plurality of clamps configured to apply an inward force against ram 130 and engage with one or more corresponding recesses in the exterior surface of ram 130 (e.g., inner locking mechanism 136). Outer locking mechanism 128 preferably engages with inner locking mechanism 136 automatically to persistently lock expendable fluid drive actuator 102 in an extended state (e.g., ram 130 actuated within piston housing 120 such that the foundation structure is in a lifted position) and retain the foundation structure in the lifted position, as discussed with respect to FIGS. 2A and 2B. In additional or alternative embodiments, outer locking mechanism 128 may be manually triggered to engage with inner locking mechanism 136 and/or a portion of ram 130 via an activation rod, remote signaling, or other manual activation methods suitable for operations described herein. For example, an activation rod may be extended through leave-outs in the foundation structure (e.g., supporting later installation of plumping, electrical, or like utilities) to engage with one or more rotation-activated, treaded nuts (e.g., outer locking mechanism 128) designed to engage with threaded portions of ram 130 (e.g., inner locking mechanism 136) to persistently lock expendable fluid drive actuator 102 in an extended position. In another example, one or more battery-powered clamps (e.g., outer locking mechanism 128) may be triggered by remote signaling to grip inner locking mechanism 136 (e.g., recesses within the surface of shaft 132, corresponding surface perturbations of shaft 132, etc.) to persistently lock expendable fluid drive actuator 102 in an extended position.

Lifting anchor 140 of the illustrated embodiment of expendable fluid drive actuator 102 may be made of metal (e.g., different types of steel, titanium, tungsten, Inconel, aluminum, other metals suitable for operations described herein, and alloys thereof), composite materials (e.g., carbon fiber composites, engineered materials, graphene, etc.), polymers and/or the like, any other materials suitable for operations described herein, or combinations thereof. In some embodiments, lifting anchors 140 may be a lifting plate (e.g., plate, disc, etc.) physically coupled (e.g., welded, soldered, adhered, etc.) to sleeve 122 near opening 127 and having appropriate dimensions (e.g., size, shape, thickness, etc.) to engage with a foundation structure and to support to the foundation structure during lifting operations, as discussed below in FIGS. 2A and 2B. The transverse dimensions of the lifting plate (e.g., lifting anchor 140) are preferably greater than the transverse dimensions of sleeve 122. The lifting plate may include passage 142 (e.g., an opening, orifice, etc.) having dimensions corresponding to the transverse dimensions of opening 127 and suitable to accommodate passage of shaft 132 of ram 130 during a lifting operation, as will be better understood from the discussions that follow. For example, the diameter of passage 142 may be greater than the diameter of shaft 132. In additional or alternative embodiments, lifting anchors 140 may comprise tabs, anchors, hooks, any other type of anchors extending out from the exterior surface of sleeve 122 that may be embedded in or otherwise engaged with the foundation structure to support the lifting operations described herein. In some embodiments, lifting anchor 140 may be configured to function as or in conjunction with outer locking mechanism 128 to engage with inner locking mechanism 136 to persistently lock expendable fluid drive actuator 102 in an extended state and retain the foundation structure in a lifted position, as discussed below with respect to FIGS. 2A and 2B.

Referring again to FIG. 1, ram 130 of the illustrated embodiment of expendable fluid drive actuator 102 includes shaft 132, piston head 134, interface 137, and inner locking mechanism 136. In operation, the components of ram 130 may be disposed at the opposite end of sleeve 122 with respect to end cap 126 and configured to slidably mount or otherwise engage into piston chamber 123 of sleeve 122 via opening 127 and cooperate with the components of piston housing 120 in raising a foundation structure to a lifted position and retaining the foundation structure in the lifted position. FIGS. 2A and 2B, below, show an example of ram 130 actuating within piston housing 120 to apply a pushing force against structural support 110 to raise foundation structure 220.

According to embodiments, shaft 132 of ram 130 may be configured (e.g., sized) to be slidably mounted within piston chamber 123 of sleeve 122 to support the operations of ram 130 in lifting and retaining the foundation structure in a lifted position. In some embodiments, shaft 132 may comprise a solid structure such as, for example a rod, bar, or other structure suitable for operations described herein. In additional or alternative embodiments, shaft 132 may, for example, comprise a length of pipe (e.g., different types of steel, titanium, tungsten, Inconel, aluminum, metal alloys, composite materials, carbon fiber, engineered materials, other materials suitable for operations described herein, and alloys thereof) or other structure having appropriate openings, orifices, or other configurations suitable for circumscribing ram chamber 133. For example, inner locking mechanism 136 may be disposed within ram chamber 133, as described below with respect to FIGS. 2A and 2B. In another example, ram chamber 133 may be configured to receive chemically curable media (e.g., poured cement, grout, epoxy, etc.) by removing a bolt within piston head 134, as described below with respect to FIGS. 2A and 2B, after expendable fluid drive actuator 102 has been persistently locked in an extended state, thereby creating a conduit between the fluid chamber (e.g., fluid chamber 274 of FIGS. 2A and 2B) of piston chamber 123 and ram chamber 133 through which grout injected into the fluid chamber may flow into ram chamber 133.

In accordance with embodiments of the invention, the longitudinal length of shaft 132 may be selected to correspond to a desired height to which the foundation structure is to be raised at a location at which shaft 132 is to be disposed and, preferably, to the length of piston housing 120, as discussed below. For example, the longitudinal length of shaft 132 may be selected such that, when combined with a thickness of one or more other components (e.g., piston head 134, interface 137, inner locking mechanism 136, etc.) of ram 130, the combined structure will extend, or substantially extend, through piston chamber 123 of piston housing 120. In the example of FIGS. 2A and 2B, wherein the combined structure of ram 130 substantially extends through piston housing 120, the longitudinal length of shaft 132, thickness of piston head 134, longitudinal length of interface 137, and length of inner locking mechanism 136 may combine to approximate the longitudinal length of piston chamber 123 within sleeve 122 at a location at which the foundation lift interface assembly is disposed. In this example, the lifting plate (e.g., lifting anchor 140) of piston housing 120 may rest upon interface 137 and facilitate formation of the foundation structure upon a ground surface. The transverse dimensions (e.g., area, perimeter, diameter and circumference, major and minor axes, cross-sectional length, etc.) of shaft 132 may correspond to the transverse dimensions of piston chamber 123.

According to embodiments, interface 137 of ram 130 may be disposed at an opposing end of shaft 132 from piston head 134 and configured to engage with support structure 110. Support structure 110 of embodiments may include pier 112 (e.g., helical piers, drilled shaft piers, pressed concrete or steel pilings, spread footings, natural rock, etc.) embedded into a ground surface. In some embodiments, interface 137 may comprise base flange 138 configured to be disposed on a ground surface and support attachment 139 physically coupled (e.g., welded, soldered, adhered, etc.) to base flange 138 and configured to receive and circumscribe a top portion of pier 112. The transverse dimensions and shape of interface 137 may correspond to the transverse dimensions and shape of pier 112. For example, support attachment 139 may include a sleeve having a diameter corresponding with the diameter of pier 112 and configured to receive and circumscribe pier 112 therein. In operation, interface 137 of ram 130 may apply a pushing force against pier 112 as piston housing 120 actuates ram 130, thereby transferring a lifting force via lifting anchors 140 to raise the foundation structure to a lifted position. In additional or alternative embodiments, interface 137 may comprise a nub, bar, stem, pin, or other configuration suitable for interfacing with pier 112. For example, a base plate may be disposed atop support structure 110 with a cuplike receptacle, recessed area, or hole, such as shown and described in the above referenced U.S. Patent Application entitled "SYSTEMS AND METHODS FOR INSTALLING AND STABILIZING A PIER" In another example, interface 137 may include a pin or spike (e.g., support attachment 139) operable to be embedded within pier 112. Shaft 132 of embodiments may be fabricated to include interface 137 as a structural component thereof. Additionally or alternatively, interface 137 of embodiments may be coupled to shaft 132 by, for example, welding, soldering, metallic adhesives, or other physically coupling methods suitable for operations described herein.

Piston head 134 of ram 130 may be physically coupled to an end of shaft 132 opposite to interface 137 and configured to slidably mount into piston chamber 123 via opening 127 of sleeve 122. In combination with end cap 126 and the interior surface of sleeve 122, piston head 134 may delineate the boundaries of the fluid chamber (e.g., fluid chamber 274 of FIGS. 2A and 2B) of piston chamber 123. In operation, piston head 134 may be configured to slide or otherwise move within piston chamber 123 and actuate shaft 132 as the fluid chamber of piston chamber 123 expands due to an influx of fluids (e.g., oil, water, air, purified gas, grout, cement, epoxy, silica sand, silica beads and/or gel, etc.) into piston chamber 123. Piston head 134 of embodiments may comprise metal, ceramic, composite material, polymers, any other materials suitable for operations described herein, or combinations thereof. The dimensions and shape of piston head 134 preferably correspond to the transverse dimensions and shape of sleeve 122 and may be configured to facilitate sliding along the longitudinal length of the interior surface of sleeve 122 and resist leakage of fluid out of the fluid chamber of piston chamber 123. For example, piston head 134 may comprise an a washer (e.g., steel, copper, brass, aluminum, metal alloy, plastic, ceramic, nylon, etc.), an end cap (e.g., steel, copper, brass, aluminum, metal alloy, or like materials corresponding to shaft 132) for coupling with shaft 132 and including a threaded hole, a cup seal (e.g., rubber, plastic, leather, etc.) with a hole sandwiched between the washer and the endcap and circumscribing the washer, and a threaded bolt for locking the washer, cup seal, and end cap together, as described in FIGS. 2A and 2B. In another example, piston head 134 may comprise two lubricated steel plates sandwiched around a rubber, O-ring gas seal. In some embodiments, piston head 134 may be coupled (e.g., welded, soldered, adhered, etc.) to shaft 132. For example, piston head 134 may comprise two circular plates sandwiching a rubber O-ring and may be welded to a square rod (e.g., shaft 132). In additional or alternative embodiments, shaft 132 may be fabricated in such a manner that piston head 134 is a structural component thereof. For example, piston head 134 may be one end of a solid, square rod comprising shaft 132. In another example, piston head 134 may be one end of a circular rod comprising shaft 132 that has been hollowed out to include ram chamber 133. In some embodiments, the transverse dimensions of piston head 134 may correspond to the transverse dimensions of shaft 132. For example, piston head 134 may be one structural end of a circular rod comprising shaft 132. Additionally or alternatively, the transverse dimensions of piston head 134 may differ from the transverse dimensions of shaft 132. For example, piston head 134 may be a square, slidable seal within piston chamber 123 while shaft 132 may be a circular rod physically coupled to piston head 134 as described herein.

In accordance with embodiments, inner locking mechanism 136 may include apertures, clamps, slots, tabs, compressible and/or expandable seals (e.g., metallic C-ring, rubber O-ring, etc.), any other interfaces and/or mechanisms suitable for operations described herein, or combinations thereof. Inner locking mechanism 136 is preferably disposed at an end of shaft 132 near piston head 134. In some embodiments, inner locking mechanism 136 of embodiments may be a structural component of shaft 132 and/or piston head 134. For example, inner locking mechanism 136 may be plurality of depressions in the outer surface of shaft 132 configured to receive locking pins of outer locking mechanism 128. In some embodiments, inner locking mechanism 136 may be enclosed within ram chamber 133, as discussed with respect to FIGS. 2A and 2B.

In operation according to embodiments, inner locking mechanism 136 may be configured to automatically engage with outer locking mechanism 128, as discussed below, to persistently lock piston housing 120 and ram 130 in an extended state (e.g., foundation structure in a lifted position). Additionally or alternatively, an activation mechanism may be triggered to selectively engage inner locking mechanism 136 and/or outer locking mechanism 128 with the other. For example, inner locking mechanism 136 may include one or more cams extending outward from piston head 134 and outer locking mechanism 128 may include corresponding slots in the interior surface of sleeve 122 configured to receive the cams of inner locking mechanism 136 and comprising portions extending along the longitudinal length of sleeve 122 and angled portions near opening 127 of sleeve 122. An activation rod physically coupled (e.g., welded, soldered, adhered, etc.) to piston head 134 and extending through piston chamber 123 and end cap 126 and may be rotated to engage the cams of inner locking mechanism 136 into the angled portions of the slots of outer locking mechanism 128 to retain ram 130 and piston housing 120 in an extended state. According to embodiments, inner locking mechanism 136 and outer locking mechanism 128 of embodiments may cooperate to persistently lock expendable fluid drive actuator 102 in an extended state independent of or in conjunction with any curable media that may be injected into the fluid chamber of piston housing 120.

FIGS. 2A and 2B depict an example process for raising and retaining a foundation structure to a lifted position using an expendable foundation lift system according to embodiments of the invention. FIG. 2A illustrates structural support 110 embedded in ground surface 210 where a new foundation is to be formed and upon which expendable fluid drive actuator 102 may be installed in a compressed state (e.g., ram 130 fully or near fully engaged within piston housing 120). In accordance with embodiments, ram 130 may be slidably disposed within piston chamber 123 of piston housing 120. Inner locking mechanism 250 of ram 130 may include locking pins 252 and 253, a compressed spring (e.g., compression spring 254) disposed between locking pins 252 and 253, and corresponding eyelets 256 and 257 (e.g., passages though shaft 132) configured to slidably mount locking pins 252 and 253 therein. A lifting plate (e.g., lifting anchor 140) of piston housing 120 and interface 137 of ram 130 may be disposed atop pier 112 of structural support 110. Piston head 232 (e.g., corresponding to piston head 134 of FIG. 1) of ram 130 and end cap 126 of piston housing 120 are preferably separated by fluid chamber 274 (e.g., a portion of piston chamber 123 configured to receive fluids 272). Piston head 232 of embodiments may include end cap 234 configured to physically couple with shaft 132 and including a threaded hole, washer 236, cup seal 235 including a hole and circumscribing washer 236 and sandwiched between washer 236 and end cap 234, and threaded bolt 237 securing washer 236, cup seal 235, and end cap 234 together. Poured concrete or other foundation media may be poured and cured into foundation structure 220.

According to embodiments, fluids 272 may be pumped into fluid chamber 274 via fluid port 124 and may include liquids (e.g., oil, pressurized water, treated water, untreated water, etc.), gases (e.g., compressed air, etc.), any other fluids suitable for operations described herein. In some embodiments, fluids 272 may include media operable to cure into a solid such as, for example, grout, cement, epoxy, or any other material suitable for operations described herein. Additionally or alternatively, fluids 272 may include expandable media such as, for example, polyurethane foam and/or the like materials that create pressure through expansion and are suitable for operations described herein. In operation according to embodiments, the influx of fluids 272 into fluid chamber 274 may cause fluid chamber 274 to expand, thereby exerting a pushing force on piston head 134, transferring such force against shaft 132 and interface 137, and actuating ram 130 against pier 112 of structural support 110. Pressure from expanding fluid chamber 274 against washer 236 may cause the lips of cup seal 235 (e.g., portions of cup seal 235 circumscribing washer 236) to press against the interior surface of sleeve 122, thereby preventing leakage of fluid 272 out of fluid chamber 274 and resisting regressive motion of ram 130 through piston housing 120. As ram 130 actuates against pier 112, statically fixed in ground surface 210, a lifting force may be transferred to lifting anchor 140 (e.g., a lifting plate) and sleeve 122. Accordingly, foundation structure 220 may be raised along with lifting anchor 140 and piston housing 120 above ground surface 210 and creating void 262 between foundation structure 220 and ground surface 210.

Figure 3A:
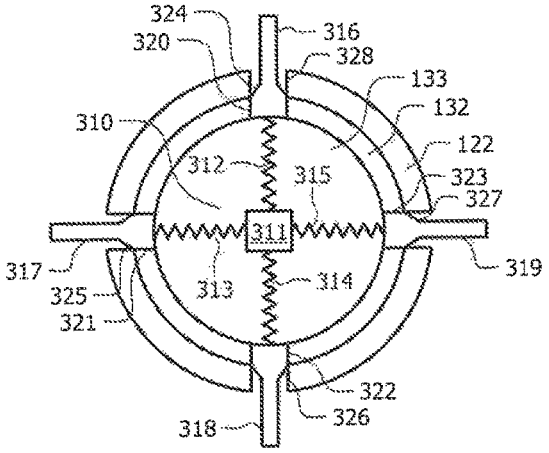
FIGS. 3A through 3F illustrate details of components of a fluid drive actuator of an expendable foundation lift system of embodiments of the present invention.

Turning to FIG. 2B, as fluid chamber 274 continues to expand due to the influx of fluids 272 into piston chamber 123, inner locking mechanism 250 may be extruded from piston chamber 123. In operation according to embodiments, once inner locking mechanism 250 is clear of piston chamber 123, compression spring 254 may decompress, thereby extending a portion or a majority of locking pins 252 and 253 outward from ram chamber 133 via eyelets 256 and 257. Although inner locking mechanism 250 is depicted in FIGS. 2A and 2B with one compression spring and two pins, it is noted that this for purposes of illustration, rather than by way of limitation, and embodiments of the present invention may utilize more than one spring and two locking pins, for example as depicted in FIG. 3A. According to embodiments, locking pins 252 and 253 may extend outward from the exterior surface of shaft 132, and lifting anchor 140 (e.g., functioning as outer locking mechanism 128) may rest upon or otherwise engage locking pins 252 and 253. Accordingly, locking pins 252 and 253 may impede any downward movement of piston housing 120 and lifting anchor 140, thereby retaining expendable fluid drive actuator 102 in an extended state and foundation structure 220 in a lifted position over void 262. It is noted that locking pins 252 and 253 and corresponding eyelets 256 and 257 are depicted as corresponding pairs for purposes of illustration, rather than by way of limitation, and embodiments of the present invention may be configured with a plurality corresponding eyelets along the longitudinal length of shaft 132 to facilitate selection and/or adjustment of the extended state to which expendable fluid drive actuator 102 may be persistently locked, more than two locking pins and eyelets as depicted in FIG. 3A, or other configurations suitable for operations described herein.

In some embodiments, the liquids and/or gases of fluids 272 may be removed from fluid chamber 274 via fluid port 124 and replaced with media operable to cure into a solid and/or materials operable to expand under pressure. For example, once the pressurized water of fluids 272 has actuated ram 130 and caused compression spring 230 to decompress and locking pins 252 and 253 to engage with lifting anchor 140 to retain foundation structure 220 in a lifted position, the pressurized water displaced out of fluid chamber 274 via a first fluid port of fluid port 124 with grout injected into fluid chamber 274 via a second fluid port of fluid port 124. As the grout hardens into a solid, the resulting solid structure of fluid chamber 274 may operate to impede the regression of piston head 134 into piston chamber 123. Additionally or alternatively, fluids 272 used to expand fluid chamber 274 and actuate ram 130 may be configured to cure into a solid structure, thereby operating in conjunction with or in lieu of locking pins 252 and 253 (e.g., components of inner locking mechanism 136) and lifting anchor 140 (e.g., functioning as outer locking mechanism 128) to retain foundation structure 220 in a lifted position. For example, grout (e.g., fluids 272) may be injected into the piston chamber to actuate piston head 134 and shaft 132. When compression spring 230 decompresses and locking pins 252 and 253 to engage with lifting anchor 140 to impede further movement of piston head 134, the grout may solidify within fluid chamber 274 and, in cooperation with engaged locking pins 252 and 253, render expendable fluid drive actuator 102 persistently (e.g., permanently or substantially permanently) locked in an extended state. In further embodiments, once locking pins 252 and 253 have persistently locked expendable fluid drive actuator 102 in an extended position, threaded bolt 237 may be removed, thereby providing a conduit to facilitate flow of any curable media injected into fluid chamber 274 into ram chamber 133. Although the example configuration of expendable fluid drive actuator 102 of FIGS. 2A and 2B is depicted as exerting a downward pushing force against pier 112 to raise foundation structure 220 to a lifted position, it is noted that this for purposes of illustration, rather than by way of limitation, and embodiments of the present invention may configure expendable fluid drive actuator 102 in order to raise foundation structure 220 by applying an upward pushing force against the underside of foundation structure 220. For example, end cap 126 of piston housing 120 may be engaged with structural support 110, interface 137 may be embedded or otherwise engaged with foundation structure 220, and fluids 272 may be pumped into fluid port 124 disposed on sleeve 122, by way of leave-outs in foundation structure 220 (e.g., supporting later installation of plumping, electrical, or like utilities), to actuate ram 130 and apply an upward lifting force to foundation structure 220.

Figure 3B:
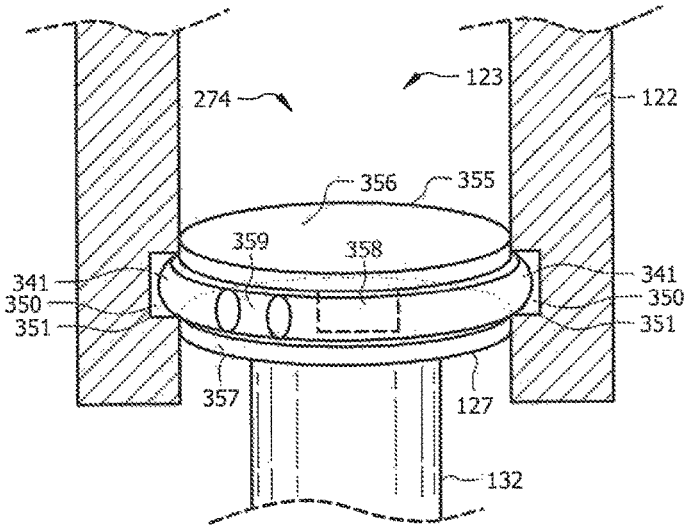
Figure 3C:
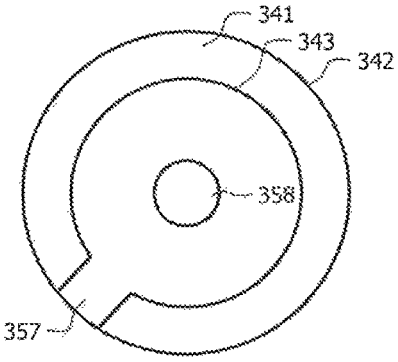

FIGS. 3A through 3C illustrates various configurations for inner locking mechanism 136 and outer locking mechanism 128 for retaining expendable fluid drive actuator 102 in an extended state and foundation structure 220 in a lifted position, in accordance with embodiments of the invention. FIG. 3A depicts inner locking mechanism 310 (e.g., corresponding to inner locking mechanism 136 of FIG. 1) comprising spring base 311 and compression springs 312, 313, 314, and 315 extending therefrom engaged with outer locking mechanism 328 (e.g., corresponding to outer locking mechanism 128 of FIG. 1). Compression springs 312, 313, 314, and 315 of embodiments may be physically coupled (e.g., embedded within, welded to, soldered to, adhered to, etc.) to locking pins 316, 317, 318, and 319, respectively. Inner locking mechanism 310 of embodiments may be disposed within ram chamber 133 and locking pins 316, 317, 318, and 319 may be slidably mounted within eyelets 320, 321, 322, and 333, respectively, of shaft 132. The orientation of shaft 132 in piston chamber 123 is preferably configure to align eyelets 320, 321, 322, and 333 of shaft 132 along an axis of intended lifting with outer locking mechanism 328 comprising corresponding eyelets 324, 325, 326, and 327 disposed in the interior surface of sleeve 122.

In operation according to embodiments, when compression springs 312, 313, 314, and 315 are compressed, locking pins 316, 317, 318, and 319 are preferably withdrawn into shaft 132 to facilitate movement of shaft 132 within piston chamber 123. As the expansion of fluid chamber 274 causes shaft 132 to move within piston chamber 123 according to embodiments, the movement of shaft 132 may cause eyelets 320, 321, 322, and 333 of shaft 132 to overlay with eyelets 324, 325, 326, and 327 of sleeve 122, respectively, thereby enabling compression springs 312, 313, 314, and 315 of embodiments to decompress and extend locking pins 316, 317, 318, and 319 outward from shaft 132 through eyelets 320, 321, 322, and 333 of shaft 132 and through eyelets 324, 325, 326, and 327 (e.g., outer locking mechanism 328) of sleeve 122. In this way, locking pins 316, 317, 318, and 319 of inner locking mechanism 310 may engage with eyelets 324, 325, 326, and 327 of outer locking mechanism 328 to retain ram 130 in a fixed position within piston housing 120. It is noted that the locking pins 316, 317, 318, and 319 (e.g., components of inner locking mechanism 310) are described as engaging with eyelets 324, 325, 326, and 327 of outer locking mechanism 328 for purposes of illustration, rather than by way of limitation, and, in other embodiments, locking pins 316, 317, 318, and 319 may be engaged with a lifting plate (e.g., lifting anchors 140) functioning as outer locking mechanism 128, as described with respect to FIGS. 2A and 2B, or other configurations of outer locking mechanism 128.

FIGS. 3B and 3C illustrate various perspectives of inner locking mechanism 340 (e.g., corresponding to inner locking mechanism 136 of FIG. 1) comprising C-ring 341 and outer locking mechanism 350 (e.g., corresponding to outer locking mechanism 128 of FIG. 1) comprising recess 351. According to embodiments, piston head 355 (e.g., corresponding to piston head 134 of FIG. 1) may be slidably mounted in sleeve 122 of piston housing 120 and may include plates 356 and 357 coupled by stalk 358 therebetween and separated by void 359. Void 359 and stalk 358 are preferably sized to accommodate C-ring 341. C-ring 341 of embodiments may be made of, for example, tungsten, Inconel, aluminum, other metals suitable for operations described herein, and alloys thereof), composite materials (e.g., carbon fiber composites, engineered materials, graphene, etc.), polymers and/or the like, or combinations thereof and may be configured to be installed into piston head 355 by encircling stalk 358 and occupying void 359. According to embodiments, C-ring 341 preferably includes two unjoined ends, thereby facilitating compression of C-ring 341 (e.g., bringing the two ends together, overlapping the two ends, etc.). When compressed, outer circumference 342 of C-ring 341 is preferably less than the circumference of plates 356 and 357 to facilitate movement of piston head 355 within piston chamber 123. When decompressed, outer circumference 342 of C-ring 341 preferably exceeds the circumference of plates 356 and 357 while inner circumference 343 of C-ring 341 is preferably less than the circumference of plates 356 and 357. It is noted that although C-ring 341 is depicted with two non-overlapping ends for purposes of illustration, rather than by way of limitation, and, in other embodiments, the two ends of C-ring 341 may overlap, effectively forming a compressible O-ring.

Recess 351 of embodiments may be a slot, channel, or other configuration suitable for operations described herein disposed within the interior surface of sleeve 122. The orientation of recess 351 may align with piston head 355 along the axis of intended lifting and may be sized (e.g., thickness, depth, shape, etc.) to correspond to the dimensions (e.g., thickness, curvature, etc.) of C-ring 341 when decompressed. In operation according to embodiments, an influx of fluids 272 into fluid chamber 274 may apply a pushing force against piston head 355 to move piston head 355 along the longitudinal length of piston chamber 123. C-ring 341 is preferably compressed while piston head 355 moves within piston camber 123. When movement of piston head 355 within sleeve 122 according to embodiments described herein causes void 359 of piston head 355 to align with recess 351 of sleeve 122, C-ring 341 may decompress and expand into recess 351, thereby impeding further movement (e.g., forward or backward) of piston head 355 within piston chamber 123. For example, outer circumference 342 of C-ring 341 may correspond to the dimensions of recess 351 (e.g., depth into sleeve 122) and an outer portion of C-ring 341 (e.g., the delta between decompressed outer circumference 342 and the circumference of plates 356 and 357 of piston head 355) may be disposed within recess 351 while an inner portion of C-ring 341 (e.g., the delta between decompressed inner circumference 343 and the circumference of plates 356 and 357 of piston head 355) remains disposed within void 359 of piston head 355. Accordingly, ram 130 and piston housing 120 may be retained in an extended state in accordance with embodiments of the invention.

Figure 3D:
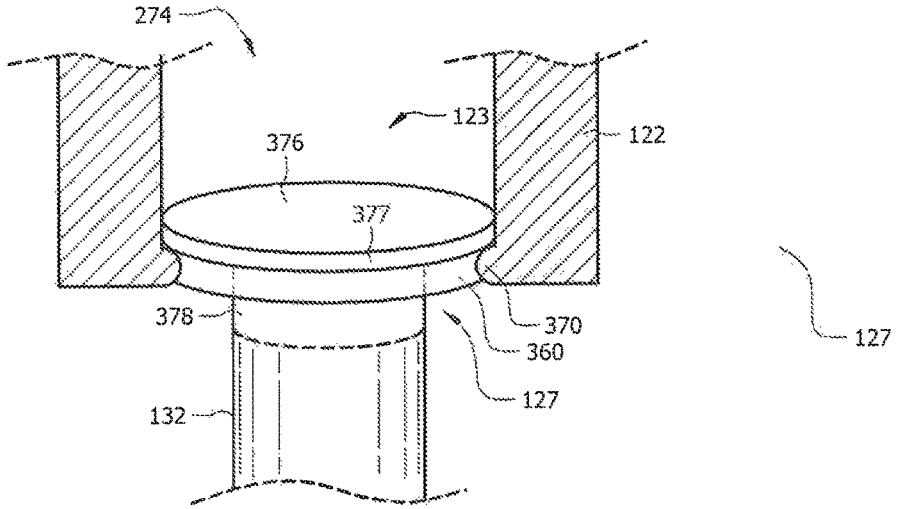
Figure 3E:
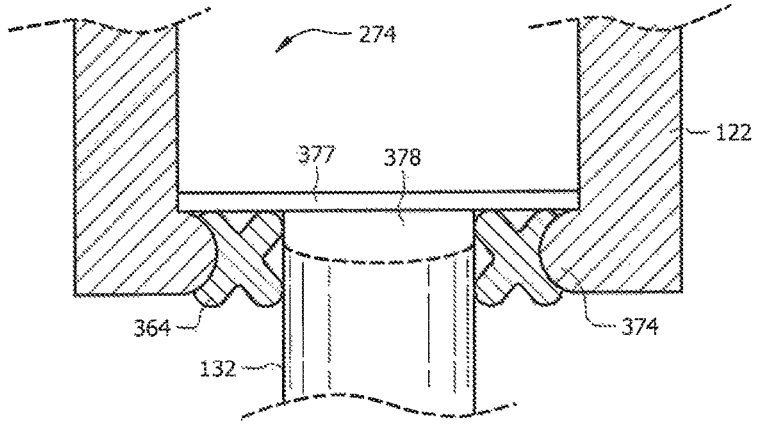
Figure 3F:
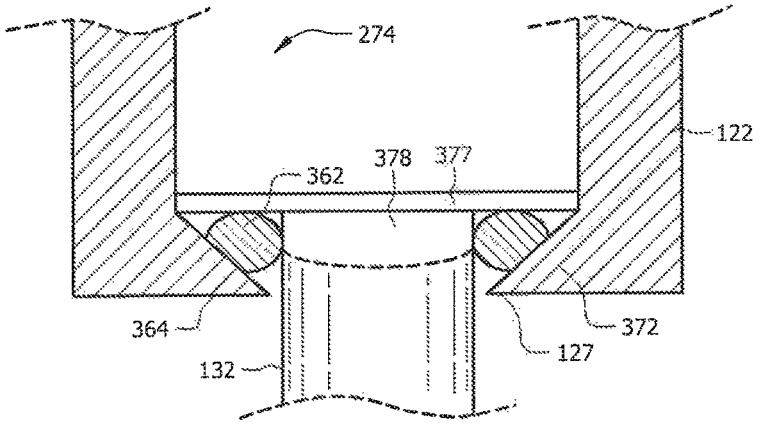

FIGS. 3D through 3F illustrate flexible O-ring 360 and bevel 370 and various cross-sections thereof operable to support retention of ram 130 and piston housing 120 in an extended state (e.g., foundation structure in a lifted position). As depicted in FIG. 3D according to embodiments, piston head 376 (e.g., corresponding to piston head 134 of FIG. 1) may be slidably mounted in sleeve 122 of piston housing 120 and may include plate 377 and mount 378 coupled to plate 377. O-ring 360 may be installed around mount 378, preferably, in such a manner that O-ring 360 is secured to 357. O-ring 360 of embodiments may be made of, for example, synthetic rubbers (e.g., nitrile rubber, fluoroelastomer, etc.), thermoplastics (e.g., thermoplastic polyurethane, thermoplastic elastomer, etc.), or any other materials suitable for operations described herein. A cross-sectional shape (e.g., circular, trapezoidal, elliptical, etc.) of O-ring 360 may correspond to the dimensions of bevel 370 to facilitate the operations described below. In some embodiments, mount 378 may be physically coupled to shaft 132 as described above. Additionally or alternatively, mount 378 may be shaft 132 interfacing with plate 377 of piston head 376.

Bevel 370 of embodiments preferably extends inward from the interior perimeter of sleeve 122, preferably circumscribing piston chamber 123 at or near opening 127, and may be sized to accommodate passage of shaft 132 of ram 130. In operation according to embodiments, as movement of piston head 376 according to embodiments engages O-ring 360 against bevel 370, the dimensions (e.g., angling, curvature, etc.) of bevel 370 are preferably configured to apply a predictable deformation to O-ring 360 such that mechanical stresses at contact surfaces of O-ring 360 with bevel 370 and mount 378 may resist separation. For example, as depicted in FIG. 3E, O-ring 360 may comprise X-shaped cross-section 364 and bevel 370 may be configured with curvature 374 (e.g., an arched extension from the interior surface of sleeve 122). Pressure caused by expanding fluid chamber 274 may engage O-ring 360 against curvature 374 of bevel 370, thereby causing curvature 374 of bevel 370 to be disposed between prongs of X-shape 364 of O-ring 360. In another example depicted in FIG. 3F, O-ring 360 may comprise circular cross-section 362 and bevel 370 may be configured with inward angle 372 (e.g., a first side extending inward at an end of sleeve 122 and angling to the interior surface of sleeve 122 at a second side). Pressure caused by expanding fluid chamber 274 may engage O-ring 360 against inward angle 372 of bevel 370, thereby applying constrictive pressure to O-ring 360. O-ring 360 and bevel 370 of embodiments may be combined with curable fluids 272 (e.g., grout, epoxy, cement, etc.) to retain ram 130 and piston housing 120 in an extended state in accordance with embodiments of the invention.

Figure 4:
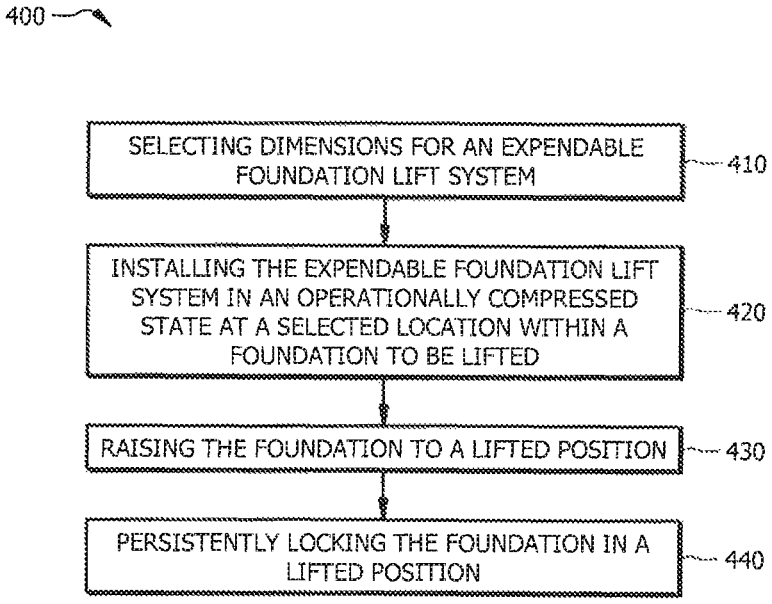
FIG. 4 illustrates a flow diagram for an operation to persistently lock a foundation in a lifted position using an expendable foundation lift system of embodiments of the present invention.

FIG. 4 illustrates example flow 400 for operation of foundation lifting systems using expendable fluid drive actuators according to embodiments of the invention to raise a foundation to a lifted position and persistently lock the foundation in the lifted position. Operations of flow 400 may, for example, be implemented with respect to components of expendable fluid drive actuator 102 (e.g., piston housing 120 and ram 130), shown in FIG. 1, for raising a foundation to a desired height and retaining the foundation in its lifted position for each instance of a foundation lift point. Accordingly, although operation in accordance with flow 400 is generally described below with reference to a single instance of an expendable fluid drive actuator, it should be appreciated that any number (e.g., tens to over one hundred) of instances of expendable fluid drive actuators may be utilized (e.g., simultaneously) in providing a lifted foundation in accordance with operation of flow 500.

Flow 400 may begin at block 410, which includes selecting an expendable fluid drive actuator to raise a foundation structure. An expendable fluid drive actuator of embodiments is configured for sacrificial use with respect to a lifted foundation, whereby the expendable fluid drive actuators remains permanently or substantially permanently (i.e., throughout their useful life) encapsulated beneath its respective foundation structure. Consequently, appropriate dimensions should preferably be selected for the expendable fluid drive actuator before forming the foundation structure (e.g., foundation structure 220 of FIG. 2). According to embodiments, the longitudinal dimensions of components (e.g., piston housing 120 and ram 130 of FIG. 1) of the expendable fluid drive actuator are preferably proportional to the desired thickness of the foundation structure and/or the desired height to which the foundation structure is to be lifted (e.g., vertical dimensions of void 262 of FIG. 2). For example, at a location within the foundation to be lifted where the foundation structure is expected to be 10 inches thick, the expendable fluid drive actuator may be selected such that the combined longitudinal length of the piston housing (e.g., piston housing 120 of FIG. 1) of the expendable fluid drive actuator may be less than or equal to 10 inches. In another example, at a location within the foundation to be lifted where the foundation structure is expected to be raised 8 inches above the ground surface, the expendable fluid drive actuator may be selected such that the longitudinal length of the ram (e.g., ram 130 of FIG. 1) of the expendable fluid drive actuator may be at least 8 inches. Additionally or alternatively, the locking mechanisms of the expendable fluid drive actuator may be configured to facilitate adjustable height selection in situations where the intended height to be lifted does not correspond to the thickness of the foundation structure. For example, a plurality of eyelets (e.g., eyelets 256 and 257 of FIGS. 2A and 2B), corresponding to locking pins (e.g., locking pins 252 and 253 of FIGS. 2A and 2B), may be configured at fixed positions (e.g., 5", 8", 12", etc.) along the longitudinal length of the ram shaft (e.g., shaft 132 of ram 130 of FIGS. 2A and 2B) to facilitate selection and adjustment of the position of the locking pins to correspond to a desired lift height (e.g., differing at various locations of a ground surface, consistent at various locations of a ground surface, etc.). Preferably, the longitudinal length of the ram corresponds to the longitudinal length of the piston housing such that the ram may be slidably mounted within a piston chamber (e.g., piston chamber 123 of FIG. 1) of the piston housing, as discussed above.

Once appropriate dimensions have been selected for the expendable fluid drive actuator, at block 420 illustrated in FIG. 4, flow 400 may further include installing the expendable fluid drive actuator in a compressed state at a selected location within the foundation to be lifted. For example, various locations may be selected around the periphery of the foundation as well as throughout the interior area of the foundation, such as by engineering analysis of the loads, spans, etc., to provide adequate support for the foundation. According to embodiments, compressed state of the expendable foundation lifting system includes ram 130 slidably mounted within piston chamber 123 of piston housing 120 such that piston head 134 is disposed adjacent or nearly adjacent (e.g., residual spacing to facilitate formation of fluid chamber 274 of FIGS. 2A and 2B) to end cap 126 of piston housing 120.

It should be appreciated that positions selected for disposing instances of expendable fluid drive actuator are preferably prepared in advance in order to provide suitable subjacent support for lifting and retaining the foundation in a lifted position. For example, piers, pilings, footings, natural rock, and/or other subjacent support structure (e.g., structural support 110 of FIGS. 2A and 2B) may be prepared to receive instances of expendable fluid drive actuator 102 at various locations of a ground surface (e.g., ground surface 210 of FIGS. 2A and 2B) in preparation for forming a foundation (e.g., foundation structure 220 of FIGS. 2A and 2B) thereon. According to embodiments, the expendable fluid drive actuator may be disposed at a selected location in accordance with block 420 of flow 400 by installed an interface (e.g., interface 137 of FIG. 1) of expendable fluid drive actuator over a previously prepared for providing suitable subjacent support (e.g., pier 112). For example, the interface may include a base flange (e.g., base flange 138 of FIG. 1) configured to be disposed on ground surface 210 and support attachment (e.g., support attachment 139 of FIG. 1) configured to receive and circumscribe a top portion of pier 112.

The piston housing of the expendable fluid drive actuator (e.g., piston housing 120 of FIG. 1) is preferably embedded in or otherwise engaged with the foundation structure prior to a lifting operation utilizing the expendable fluid drive actuator 102. In an example of the piston housing engaged with the foundation structure, a poured concrete slab foundation may be formed with a lifting plate (e.g., lifting anchors 140 physically coupled to opening 127 of piston housing 120 of FIGS. 2A and 2B) disposed thereunder. In some embodiments, a plug (e.g., plug 125 of FIGS. 1 and 2A) may be disposed over an end (e.g., end cap 126 of FIG. 1) of the piston housing for displacing foundation media when the foundation structure is formed (e.g., concrete is poured), and removed thereafter to reveal a foundation media fill pocket (e.g., pocket 240 of FIG. 2B) allowing access to a fluid port (e.g., fluid port 124 of FIGS. 1, 2A, and 2B) of piston housing 120.

Once the ram and piston housing of the expendable fluid drive actuator has been installed and the foundation structure has been formed (e.g., cured concrete, etc.) thereupon, at block 430, flow 400 may further include raising the foundation structure to a lifted position. According to embodiments, fluids (e.g., fluids 272 of FIGS. 2A and 2B) may be injected into a fluid chamber (e.g., fluid chamber 274 within an interior portion of piston chamber 123 of FIGS. 2A and 2B) using a fluid port (e.g., fluid port 124 of FIGS. 1, 2A, and 2B). For example, pressurized gas may be injected into the fluid chamber via a bidirectional value. In another example, grout may be injected into the fluid chamber using a one-way valve.

Injecting fluids into the fluid chamber preferably causes the fluid chamber to expand, thereby exerting a pushing force against the piston (e.g., piston head 134 of FIGS. 1, 2, and 2B). According to embodiments, the pushing force exerted by the expanding fluid chamber may actuate ram 130 along the axis of intended lifting against the subjacent structural support (e.g., pier 112 of FIGS. 2A and 2B) to an extended state. As the ram actuates against the statically fixed structural support (e.g., pier 112 fixed in ground surface 210 of FIGS. 2A and 2B), a lifting force may be transferred to the piston housing (e.g., piston housing 120 of FIGS. 1, 2A and 2B) and the lifting anchors (e.g., lifting anchor 140 of FIGS. 1 and 2A, and 2B) engaged with the foundation structure (e.g., foundation structure 220 of FIGS. 2A and 2B). Accordingly, the foundation structure may be raised along with the piston housing above the ground surface to a lifted position, thereby creating a void space (e.g., void 262 of FIGS. 2A and 2B) between the lifted foundation structure and the ground surface.

Once the formed foundation structure has been raised to the lifted position, at block 440, flow 400 may further include retaining the foundation structure in the lifted position. In some embodiments, the fluids (e.g., fluids 272 of FIGS. 2A and 2B) injected into the fluid chamber (e.g., fluid chamber 274 of FIGS. 2A and 2B) may cure or otherwise solidify within the fluid chamber. The resulting solid may operate to impede further movement of the ram (e.g., ram 130 of FIGS. 1, 2A, and 2B) within the piston housing (e.g., piston housing 120 of FIGS. 1, 2A, and 2B) and retain the lifted foundation structure in the lifted position. Additionally or alternatively, non-curable fluids (e.g., pressurized water, compressed air, etc.) injected into the fluid chamber to actuate the ram may be replaced with curable media after the foundation structure has been raised to the lifted position. In this way, the expendable fluid drive actuator, now a solid object persistently (e.g., permanently or substantially permanently) locked in an extended state, mitigates common causes of failure prevalent in conventional hydraulic and pneumatic linear actuators related to their reusable and temporary nature and may be suitable for resisting and enduring the continual downward forces (e.g., gravitational) related to the weight of a lifted slab foundation and a structure and/or occupants thereupon.

Further, respective inner and outer locking mechanisms of the ram and the piston housing (e.g., inner locking mechanism 136 and outer locking mechanism 128 of FIGS. 1, 2A, and 2B) may be operable to impede actuator movement and persistently lock the expendable fluid drive actuator in an extended state for locking a foundation structure in a lifted position. According to embodiments, the inner and outer locking mechanisms may be configured to be automatically engaged as the piston head (e.g., piston head 134 of FIG. 1) moves through the piston chamber (e.g., piston chamber 123 of FIG. 1). For example, a compressed C-ring (e.g., C-ring 341 of FIG. 3B) installed around the piston head (e.g., piston head 355 of FIG. 3B) may decompress when movement of the piston head through the piston chamber aligns the C-ring with a corresponding recess (e.g., recess 351 of FIG. 3B) within the interior surface of the piston chamber such that a first portion of the decompressed C-ring may be engaged within the recess and a second portion remains engaged in the piston head, thereby impeding further movement of the piston head through the piston chamber. In another example, spring-locked tabs (e.g., outer locking mechanism 128 of FIG. 1) disposed within the interior surface of the piston chamber (e.g., piston chamber 123 of FIG. 1) may engage when movement of the ram (e.g., ram 130 of FIG. 1 comprising a shaft and piston head of approximately equivalent dimensions) through the piston chamber exposes the tabs to the expanding fluid chamber (e.g., fluid chamber 274 of FIGS. 2A and 2B), thereby impeding regressive movement of the ram through the piston chamber.

Additionally or alternatively, the inner and outer locking mechanisms may be configured to be manually engaged with the other. For example, one or more cams (e.g., inner locking mechanism 136 of FIG. 1) extending outward from the piston head may be engaged with corresponding slots (e.g., outer locking mechanism 128 of FIG. 1) disposed within the interior surface of the piston chamber. The piston head (e.g., piston head 134 of FIG. 1) may move through the piston chamber (e.g., piston chamber 123 of FIG. 1) along a portion of the slots extending through the longitudinal length of the piston chamber, and an activation rod coupled to the piston head through the piston chamber may be triggered to rotate the one or more cams into an angled portion of the slots, thereby impeding further movement of the piston head through the piston chamber. Accordingly, by statically impeding movement of the ram within the piston housing, the expendable foundation lifting system of embodiments may be suitable for resisting and enduring the continual forces related to the weight of a lifted slab foundation and a structure and/or occupants thereupon.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus for lifting and retaining a foundation structure in a lifted position over a ground surface comprising:

a piston housing circumscribing a piston chamber and comprising at least one fluid port, wherein the at least one fluid port is configured to receive fluids into a fluid chamber within the piston chamber, and wherein the received fluids cause the fluid chamber to expand;

a ram slidably mounted within the piston chamber, wherein expansion of the fluid chamber actuates the ram along an axis of intended lifting from a compressed state to an extended state, and wherein actuating the ram to the extended state raises the foundation structure to the lifted position and persistently locks the ram against subsequent movement through the piston chamber; and one or more locking mechanisms configured to persistently lock, subsequent to the piston housing actuating the ram to the extended state, the ram against movement through the piston chamber, wherein persistent locking of the ram provided by the one or more locking mechanisms is at least initially independent of persistent locking of the ram provided by a media of the fluids.

2. The apparatus of claim 1, wherein the piston housing is configured to be embedded within the foundation structure, and wherein the ram is configured to engage with a structural support engaged with the ground surface.

3. The apparatus of claim 1, wherein the fluids comprise curable media, and wherein curing the fluids operates in cooperation with the one or more locking mechanisms to persistently lock the ram in the extended state.

4. The apparatus of claim 1, wherein the fluids of the fluid chamber are displaced with curable media after the foundation structure is raised to the lifted position, and wherein curing the curable media persistently locks the ram in the extended state.

5. The apparatus of claim 4, wherein the one or more locking mechanisms persistently lock the ram against movement through the piston chamber during a period in which the fluids of the fluid chamber are displaced with the curable media.

6. The apparatus of claim 1, wherein the piston housing comprises an outer locking mechanism and the ram comprises an inner locking mechanism, and wherein the inner locking mechanism cooperates with the outer locking mechanism to persistently lock the ram in the extended state.

7. The apparatus of claim 6, wherein the inner locking mechanism is configured to automatically engage with the outer locking mechanism as expansion of the fluid chamber actuates the ram within the piston chamber to persistently lock the ram in the extended state.

8. The apparatus of claim 7, wherein the ram comprises an interior chamber, wherein the inner locking mechanism comprises one or more pairs of locking pins and corresponding compression springs disposed within the interior chamber of the ram, wherein the compression springs are engaged in a compressed position as expansion of the fluid chamber actuates the ram within the piston chamber, and wherein movement of the ram through the piston chamber aligning the pairs of locking pins of the inner locking mechanism with the outer locking mechanism causes the compression springs to decompress and engage the pairs of locking pins with the outer locking mechanism to persistently lock the ram in the extended state.

9. The apparatus of claim 6, wherein the outer locking mechanism of the piston housing comprises a lifting plate engaged with the foundation structure and operable to raise the foundation structure to the lifted position.

10. An expendable fluid drive actuator of a foundation lifting system for lifting and retaining a foundation structure in a lifted position comprising:

one or more outer locking mechanisms disposed on a piston housing, wherein the piston housing circumscribes a piston chamber and comprises at least one fluid port, and wherein the at least one fluid port is configured to receive fluids into a fluid chamber within the piston chamber, wherein the received fluids cause the fluid chamber to expand and actuate a ram slidably mounted within the piston chamber along an axis of intended lifting from a compressed state to an extended state, wherein actuating the ram to the extended state raises the foundation structure above a ground surface to the lifted position; and one or more inner locking mechanisms disposed on the ram operable to engage with the one or more outer locking mechanisms to persistently lock the ram in the extended state, wherein persistently locking the ram in the extended state impedes subsequent movement of the ram through the piston chamber and retains the foundation structure in the lifted position.

11. The system of claim 10, wherein the piston housing is configured to be embedded within the foundation structure, and wherein the ram is configured to engage with a structural support engaged with the ground surface.

12. The system of claim 10, wherein the fluids comprise chemically curing media, and wherein curing the fluids cooperates with the one or more inner locking mechanisms and the one or more outer locking mechanisms to persistently lock the ram in the extended state.

13. The system of claim 10, wherein the fluids of the fluid chamber are displaced with curable media after the foundation structure is raised to the lifted position to cooperate with the one or more inner locking mechanisms and the one or more outer locking mechanisms to persistently lock the ram in the extended state.

14. The system of claim 10, wherein the one or more inner locking mechanisms are configured to automatically engage with the one or more outer locking mechanisms as expansion of the fluid chamber actuates the ram within the piston chamber to the extended state.

15. The system of claim 14, wherein the ram comprises an interior chamber, wherein the one or more inner locking mechanisms comprise one or more pairs of locking pins and corresponding compression springs disposed within the interior chamber of the ram, wherein the compression springs are engaged in a compressed position as expansion of the fluid chamber actuates the ram within the piston chamber, and wherein movement of the ram through the piston chamber aligning the pairs of locking pins of the one or more inner locking mechanisms with the one or more outer locking mechanisms causes the compression springs to decompress and engage the pairs of locking pins with the one or more outer locking mechanisms.

16. The system of claim 10, wherein the one or more outer locking mechanisms of the piston housing comprise a lifting plate engaged with the foundation structure and operable to raise the foundation structure to the lifted position.

17. A method for lifting and retaining a foundation structure in a lifted position comprising:

disposing an expendable fluid drive actuator over a structural support engaged with a ground surface, wherein the expendable fluid drive actuator comprises a piston housing and a ram, wherein the piston housing circumscribes a piston chamber and comprises at least one fluid port, wherein the at least one fluid port is configured to receive fluids into a fluid chamber within the piston chamber, wherein the ram is slidably mounted in the piston chamber of the piston housing, and wherein the expendable fluid drive actuator is disposed over the structural support in a compressed state;

forming the foundation structure over the expendable fluid drive actuator, wherein the expendable fluid drive actuator is operable to engage with the foundation structure and transfer a lifting force to the foundation structure during a lifting operation;

injecting fluids into the fluid chamber via the at least one fluid port of the expendable fluid drive actuator, wherein injecting fluids into the fluid chamber causes the fluid chamber to expand, and wherein expansion of the fluid chamber exerts a pushing force against the ram;

actuating the ram of the expendable fluid drive actuator, in response to the pushing force exerted against the ram by expansion of the fluid chamber, from the compressed state to an extended state, wherein actuating the ram to the extended state raises the foundation structure to the lifted position; and persistently locking the expendable fluid drive actuator in the extended state, wherein the expendable fluid drive actuator comprises one or more locking mechanisms configured to persistently lock, subsequent to the piston housing actuating the ram to the extended state, the ram against subsequent movement through the piston chamber, and wherein persistently locking the ram in the extended state impedes subsequent movement of the ram through the piston chamber and retains the foundation structure in the lifted position and is at least initially independent of persistent locking of the ram provided by a media of the fluids.

18. The method of claim 17, wherein the ram of the expendable fluid drive actuator is disposed over the structural support, and wherein the piston housing of the expendable fluid drive actuator configured to be embedded within the foundation structure.

19. The method of claim 17, wherein persistently locking the expendable fluid drive actuator in the extended state further includes:

forming a solid within the fluid chamber, wherein the solid is operable in cooperation with the one or more locking mechanisms to impede movement of the ram within the piston housing.

20. The method of claim 19, wherein the fluids injected into the fluid chamber comprise media configured to cure into the solid.

21. The method of claim 19, further comprising:

displacing the fluids in the fluid chamber by injecting curable media into the fluid chamber via the at least one fluid port, wherein the curable media is configured to cure into the solid.

22. There method of claim 21, wherein the one or more locking mechanisms persistently lock the ram against subsequent movement through the piston chamber during a period in which the fluids of the fluid chamber are displaced with the curable media.

23. There method of claim 17, wherein the ram comprises one or more inner locking mechanisms, wherein the piston housing comprises one or more outer locking mechanisms, wherein the one or more inner locking mechanisms and the one or more outer locking mechanisms cooperate to persistently locking the expendable fluid drive actuator in the extended state.

24. The method of claim 23, wherein persistently locking the expendable fluid drive actuator in the extended state further comprises:

manually engaging the one or more inner locking mechanisms into a locked position with respect to the one or more outer locking mechanisms.

25. The method of claim 23, wherein persistently locking the expendable fluid drive actuator in the extended state further comprises:

automatically engaging, based on movement of the ram through the piston chamber, the one or more inner locking mechanisms into a locked position with respect to the one or more outer locking mechanisms.

* * * * *